US010315121B2

(12) United States Patent
Johnson, Jr. et al.

(10) Patent No.: US 10,315,121 B2
(45) **Date of Patent: *Jun. 11, 2019**

(54) FLOATING MOBILE WATER PARK

(71) Applicants: Michael David Johnson, Jr., Hixson, TN (US); Christopher Nelson Hampton, Hixson, TN (US)

(72) Inventors: Michael David Johnson, Jr., Hixson, TN (US); Christopher Nelson Hampton, Hixson, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/880,840

(22) Filed: Jan. 26, 2018

(65) Prior Publication Data

US 2018/0207538 A1 Jul. 26, 2018

Related U.S. Application Data

(63) Continuation of application No. 15/261,715, filed on Sep. 9, 2016, now Pat. No. 9,895,619.

(60) Provisional application No. 62/216,873, filed on Sep. 10, 2015.

(51) Int. Cl.

| | |
|---|---|
| ***A63B 5/11*** | (2006.01) |
| ***A63G 31/00*** | (2006.01) |
| ***A63B 5/10*** | (2006.01) |
| *A63G 21/02* | (2006.01) |
| *A63G 9/00* | (2006.01) |

(52) U.S. Cl.

CPC ..... *A63G 31/007* (2013.01); *A63B 5/10* (2013.01); *A63B 5/11* (2013.01); *A63G 31/00* (2013.01); *A63B 2225/605* (2013.01); *A63G 9/00* (2013.01); *A63G 21/02* (2013.01)

(58) Field of Classification Search

CPC ... A63G 3/00; A63G 3/02; A63G 9/00; A63G 21/00; A63G 21/18; A63G 31/00; A63G 31/007; A63B 5/00; A63B 17/00; A63B 2009/006

USPC ..... 472/3, 13, 116, 117, 128, 129; 482/27, 482/35, 36

See application file for complete search history.

(56) References Cited

U.S. PATENT DOCUMENTS

| | | | |
|---|---|---|---|
| 4,017,069 | A | 4/1977 | Daly et al. |
| 4,598,904 | A | 7/1986 | Roth |
| 4,666,147 | A | 5/1987 | Warman |
| 6,773,355 | B1 | 8/2004 | Lekhtman |
| 7,309,302 | B1 | 12/2007 | Phillips |
| 2002/0185049 | A1 | 12/2002 | Broderick et al. |

*Primary Examiner* — Kien T Nguyen

(74) *Attorney, Agent, or Firm* — Davis & Bujold PLLC; Michael J. Bujold

(57) ABSTRACT

A floating amusement apparatus includes a base, at least one elevated platform secured to and supported above the base and a plurality of user-interactive amusement accessories secured to the base or the at least one elevated platform. The base includes a modular floating dock. The floating amusement apparatus is adapted to be mobile.

20 Claims, 6 Drawing Sheets

FLOATING MOBILE WATER PARK

CROSS REFERENCE TO RELATED APPLICATIONS

This present application claims priority to U.S. Provisional Application No. 62/216,873, which was filed on Sep. 10, 2015, which is herein incorporated by reference.

BACKGROUND OF THE INVENTION

Field of the Invention

The present invention relates to amusement rides and more particularly to a water amusement assembly and more specifically to a stable, mobile, floating amusement apparatus.

Description of the Background Art

In hot summer weather, it is common to undertake water-based amusement activities. For example, swimming pools, oceans and lakes are typically enjoyed on hot weather days. Often it is desirable to use water-based amusement features such as rope swings, diving boards, water slides, etc. Often these amusement features can be found at a specific location, such as a water park. It is sometimes desirable, however, to have such amusement features at a personal location. For example, inflatable water slides are commonly rented for outdoor home or community parties.

Certain conventional systems are known for providing mobile, floating water parks. These conventional systems allow a user to set up a floating water park in, for example, a lake, bay or water front area.

Conventional floating water parks, however are not easily moved, if movable at all. Additionally, conventional floating water parks are not stable, and can be easily damaged, as they are often inflated. The conventional floating water parks must be inflated before and deflated after each use. Additionally, the individual amusement features must be individually attached to the floating water park for each use. Thus, the conventional floating water parks are less durable and require increased setup and take down time.

SUMMARY OF THE INVENTION

In view of the foregoing and other exemplary problems, drawbacks, and disadvantages of the conventional methods and structures, an exemplary feature of the present invention is to provide a stable, floating water park apparatus including a plurality of amusement features that is easily mobile.

According to a first non-limiting, exemplary aspect of the invention a floating amusement apparatus includes a base, at least one elevated platform secured to and supported above the base and a plurality of user-interactive amusement accessories secured to the base or the at least one elevated platform. The base includes a modular floating dock. The floating amusement apparatus is adapted to be mobile.

According to a second non-limiting, exemplary aspect of the invention a floating amusement apparatus includes a base, comprising a modular floating dock, a first elevated platform having a first height secured to and supported above the base, the first elevated platform having an end portion extended beyond an outermost edge of the base, a second elevated platform having a second height secured to and supported above the base, a third elevated platform having a third height secured to and supported above the base, a slide having a first end secured to the third elevated platform; a rope swing mounted on the third elevated platform and a pair of trampolines mounted on the base adjacent to the second platform, each of the trampolines being positioned at a different height. The third height is greater than the first height and the second height. The floating amusement apparatus is adapted to be mobile.

As indicated above, conventional floating water parks are not easily moved, if movable at all. The present invention, according to the above exemplary aspects, provides an improved floating amusement apparatus that is completely mobile in a single unit. That is, the floating amusement apparatus described herein can either be self-propelled by a motor or easily towed. The floating amusement apparatus is easily driven, maneuvered and anchored and can, thus, be easily moved into most slips, docks or marinas.

Additionally, conventional floating water parks are not stable as they are often inflated. The present floating amusement apparatus is not an inflatable apparatus. Instead, the base of the apparatus is made of a durable plastic modular floating dock, thus providing a stable, rigid unit that can support up to 16 tons of weight. Thus, all of the other components of the floating amusement apparatus can be built and secured to the base (permanently or semi-permanently) in a self-contained unit that can be moved together, further increasing the overall mobility of the floating amusement apparatus. Additionally, the support members and platforms are made from aluminum, further improving the durability and stability of the floating amusement apparatus.

The conventional floating water parks must be inflated before and deflated after each use. Additionally, the individual amusement features must be individually attached to the floating water park for each use. Thus, the conventional floating water parks are less durable and require increased setup and take down time. The present floating amusement apparatus can fit on standard trailers and can be easily removed from the water at access ramps and driven on the road in its completely assembled configuration. Accordingly, no on-site assembly is required by the user and the floating amusement apparatus can be left in the water year-round.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, do not limit the present invention, and wherein.

DETAILED DESCRIPTION

Figure 1:
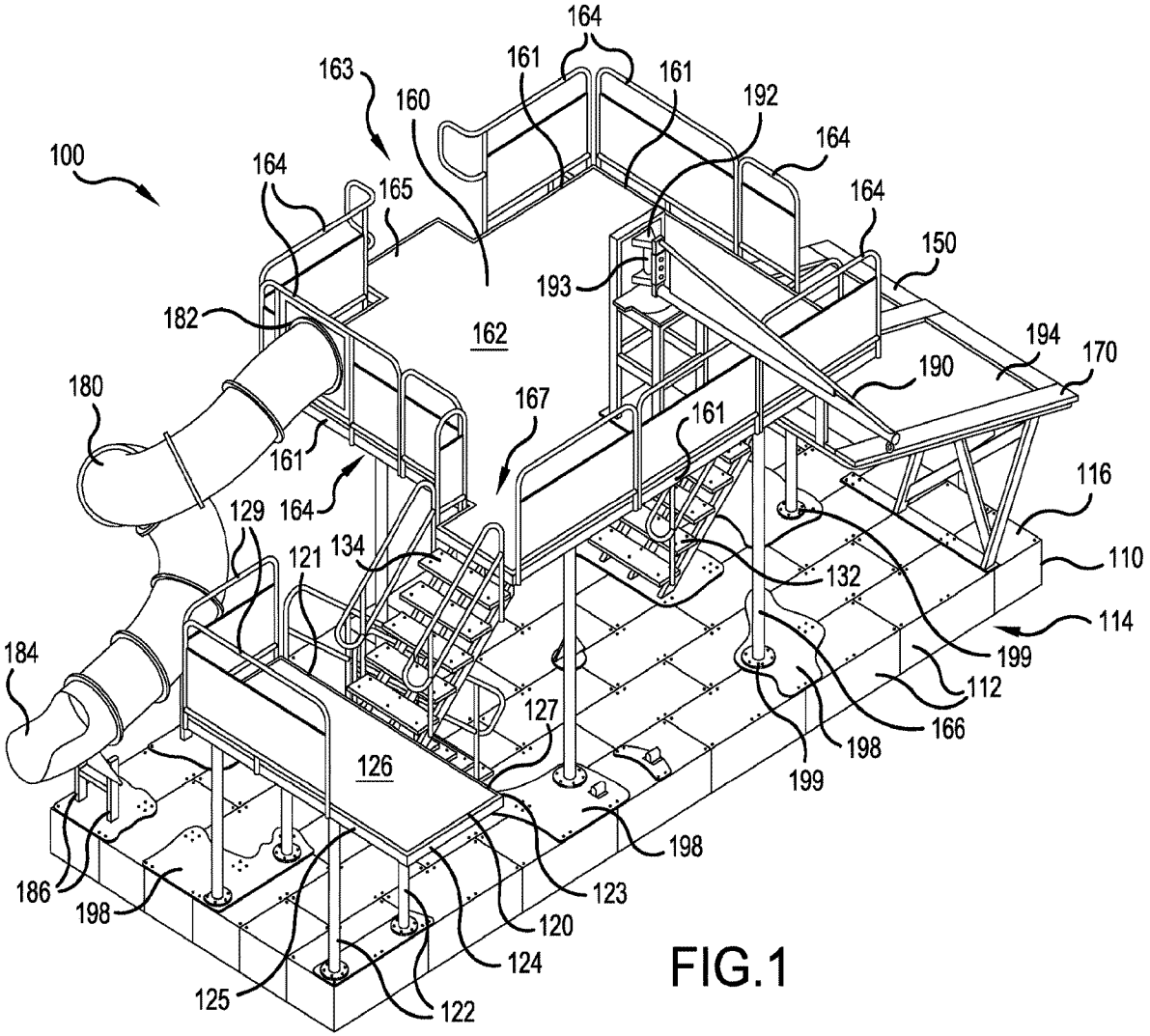
FIG. 1 illustrates a perspective view of a floating amusement apparatus 100 according to a first, exemplary, non-limiting embodiment of the present invention.

Referring now to the drawings, and more particularly to FIGS. 1-6, there are shown exemplary embodiments of the present invention.

Figure 2:
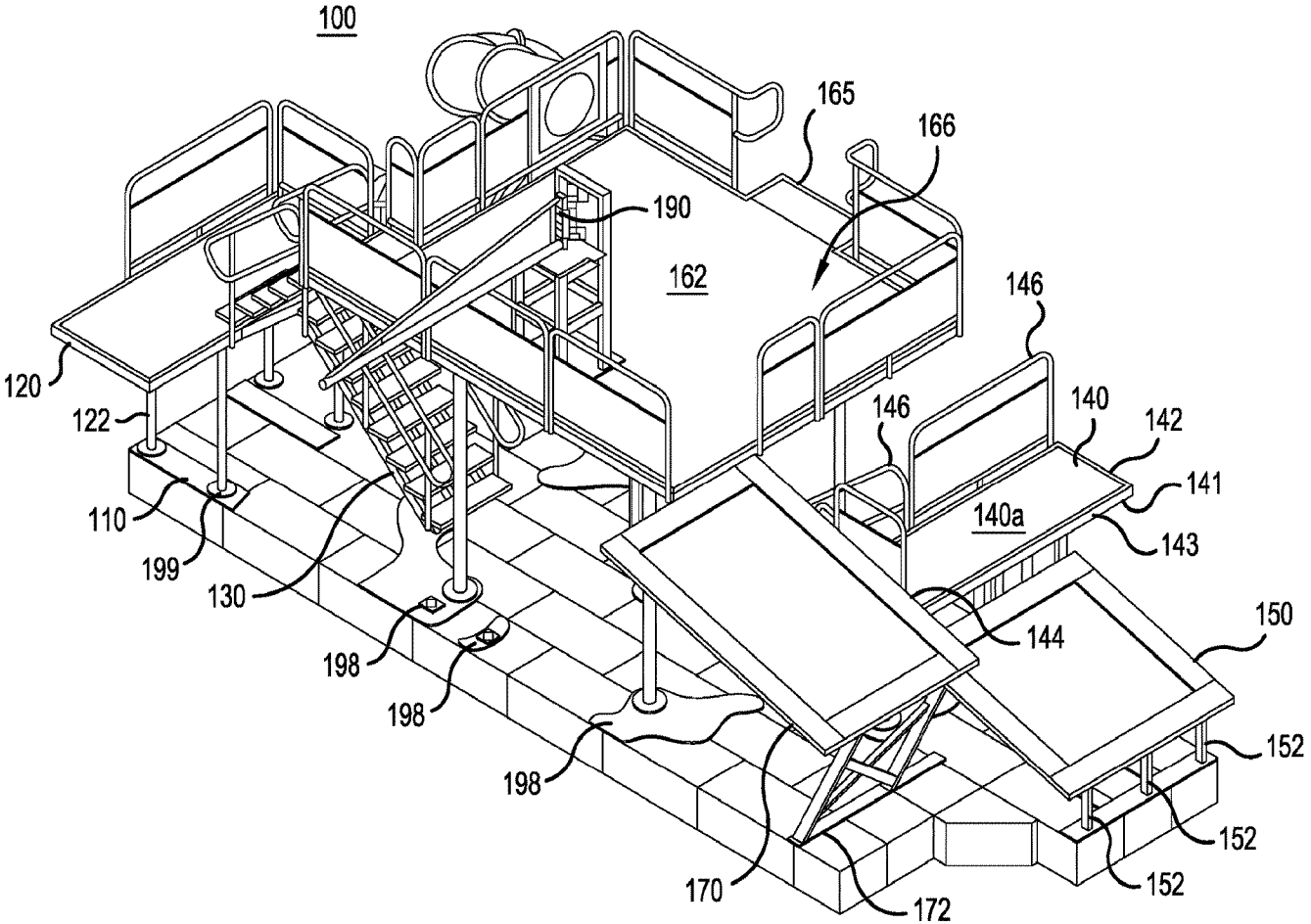
FIG. 2 illustrates another perspective view of the floating amusement apparatus 100.
Figure 3:
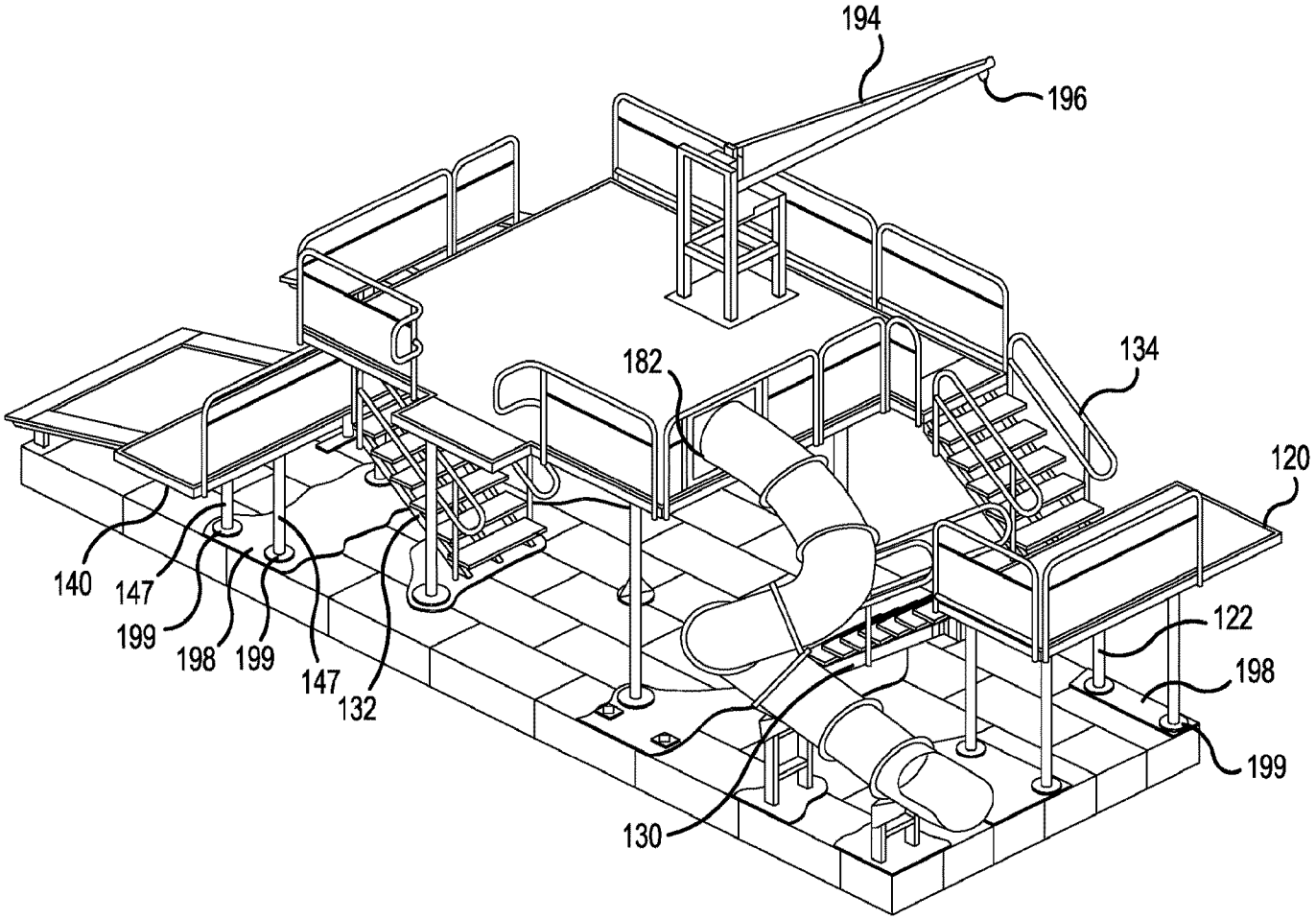
FIG. 3 illustrates another perspective view of the floating amusement apparatus 100.

FIGS. 1-3 illustrate a floating amusement apparatus 100I according to a first exemplary embodiment of the present invention. Each of FIGS. 1-3 illustrates the floating apparatus 101) from varying perspective views. The floating amusement apparatus 100 includes a base 110. The base 110 is made of a modular floating dock. The modular floating docket is constructed from a plurality of individual modules 112. The plurality of individual modules 112 form the hull of the apparatus 110 having a flat top surface 116 and a flat bottom surface 114. The modular floating dock base 110 advantageously provides a stable base, the top surface 116 of which is able to remain close to water level when the apparatus 100 is in use. All other components of the floating amusement apparatus 100 are mounted to the base 110, directly or indirectly. The floating modular dock is made from plastic or other suitably durable, stable material.

The floating amusement apparatus 100 includes at least one elevated platform. In the embodiment illustrated in FIG. 1, the apparatus 100 includes three elevated platforms, which are disposed at varying heights above the base 110. A first platform 120 is disposed at a first end of the base 110. The first platform 120 is supported by a plurality of support poles 122, which are secured at a first end to the top surface 116 of the base 110 and at a second end to a flat bottom surface 124 of the first platform 120. The first platform 120 has a flat top surface 126. The top surface 126 is covered with a soft, textured covering. For example, according to certain embodiments of the invention, the top surface 126 is covered with artificial/synthetic turf to prevent users from slipping from walking along the platform.

The first platform 120 has a first, closed end, positioned above an interior of the base 110, and a second, open, end 123, which extends beyond an outer edge of the base 110, a first side 125 and a second side 127. A closed railing 129 extends along the first end 121. A similar closed railing 129 is disposed along a portion of the first side 125. The closed railing 129 extends along the first side 125 from the first end 121 to a point above the edge of the base 110. With this construction, a user is able to run and jump from the platform 120 into the water, while being prevented from jumping or falling and landing on the base 110.

Additionally, a first staircase 130 (see FIG. 2) is attached at a bottom end to the top surface 116 of the base 110 and attached at a top end to the first platform 120. The first staircase 130 is attached to the second side 127 of the first platform 120 and is configured to allow a user to climb from the base 110 to the first platform 120.

Turning to FIGS. 2 and 3, the floating amusement apparatus 100 according to the embodiment illustrated in FIGS. 1-3 includes a second elevated platform 140. The second elevated platform 140 is supported above the base 110 by a plurality of support poles 147. The second elevated platform 140 includes a flat bottom surface 141 and a flat top surface 140*a*. Similar to the first platform 120, the top surface 141 is covered with artificial/synthetic turf. The second platform 140 has a first end 142 adjacent an outermost edge of the base 110, a first side 143, a second end 144 adjacent an interior of the base and a second side 145. A closed railing 146 extends along the second edge. Another closed railing 146 extends along a portion of the second side 145. The first end 142 extends beyond the outermost edge of the base 110 to provide another jumping/diving platform. Similar to the first platform 120, with this construction, a user is able to run and jump from the platform 140 into the water, while being prevented from jumping or falling and landing on the base 110.

The first side 143 of the second platform 140 is also open. A first trampoline 150 is positioned on the top surface 116 of the base 110 adjacent to and below the second platform 140. The open first side 143 of the second platform 140 is configured to allow a user to jump from the top surface 140*a* of the second platform 140 onto the first trampoline 150 to then propel the user into the water.

A third platform 160 is disposed in a generally center portion of the base 110. The third platform 160 is supported above the base 110 by a plurality of support poles 166. The third platform 160 has four sides 161, a flat bottom surface 164 and a flat top surface 162. Similar to the first platform 120 and the second platform 140, the top surface 162 is covered with artificial/synthetic turf. A plurality of closed railings 164 are disposed on and extend along the four sides 161 of the third platform 160.

A first opening 163 is disposed on a side 161 of the third platform 160 adjacent an outermost edge of the base 110. A high-dive extension portion 165 extends from the side 161 of the third platform 160 in the first opening 163. A second opening 166 is disposed on another of the sides 161 of the third platform 160. A second trampoline 170 is positioned on the top surface 116 of the base 110 adjacent to and below the third platform 160. The second opening 166 of the third platform 160 is configured to allow a user to jump from the top surface 162 of the third platform 160 onto the second trampoline 170 to then propel the user into the water. Additionally, a third opening 167 is disposed along another side 161 of the third platform 160. Furthermore, a slide 180 extends from the side 161 of the platform along which the third opening 167 is disposed. Lastly, a rope swing assembly 190 is positioned along another side 161 of the third platform 160.

The floating amusement apparatus 100 may include any number of platforms. For example, an embodiment of the floating amusement apparatus 100 may include one, two or three platforms. Though any number or combination of platforms may be used. The platforms are disposed at different heights. For example, in the embodiment illustrated in FIGS. 1-3, the first platform 120 is disposed at a first height, the second platform 140 is disposed at a second height and the third platform 160 is disposed at a third height. In the embodiment illustrated in FIGS. 1-3, the second height is greater than the first height and the third height is greater than the first height and the second height. This height configuration is merely exemplary and the platforms may be positioned in any suitable height configuration.

As identified above, the floating amusement apparatus includes several amusement accessories secured to either the base 110 or one of the plurality of elevated platforms. The slide 180, above, is attached at a top end 182 to a portion of the railing 164 along the third elevated platform 160 and attached at a bottom end 184 to the base 110 by a mounting beam assembly 186. The bottom end 184 extends out beyond an outermost edge of the base 110 to allow a user to drop into the water. The slide 180 is illustrated herein as a curved and closed slide. Any size or shaped slide, however, may be used in its place.

Additionally, the floating amusement apparatus may include one or more trampolines. In the embodiment illustrated in FIGS. 1-3, the apparatus includes two trampolines 150/170. This configuration is merely exemplary and any suitable number of trampolines may be used. As is illustrated in FIGS. 1-3, the trampolines 150/170 can be positioned at different heights and angles, and can be of different size. The trampolines 150/170 are secured to the top surface 116 of the base 100 using respective mounting beam assemblies 152/172.

Furthermore, the floating amusement apparatus may include the rope swing assembly 190. The rope swing assembly 190 includes a support frame 192 mounted to the top surface 162 of the third platform 160, a support arm 194 pivotably attached to and extending outwardly from the support frame 192, a pivot mount 193, which pivotably attaches the support arm 194 to the support frame 192, and a hook 196 or other fastener disposed at a distal end of the support arm. The hook 196 is configured to receive and support a rope 195 (illustrated in FIGS. 4 and 5). The rope swing assembly 190 is configured to allow a user to swing from the third platform 160 and then drop into the water below.

Moreover, the amusement accessories may include one of more of the diving area/platforms detailed above. That is, the first platform 120 includes the open end 123 extending beyond the outer edge of the base 110, the second platform 140 includes the first end 142 extending beyond the outermost edge of the base 110 and the third platform 160 includes the high-dive extension portion 165. This allows the user to jump/dive into the water from multiple varying heights.

The support poles 122/147/166 for each of the platforms and the mounting beams 152/172/186 for the amusement attractions are each connected to the top surface 116 of the base 110 through support plates 198. The support plates 198 are load distributing plates adapted to distribute the load from the support poles and mounting beams to the modular floating dock/base 110. The support plates 198 are of varying shape and size. In general, the support plates 198 have an amorphous shape to imitate puddles on the top surface 116 of the base 110. The support plates 198 are attached directly to the top surface 116 of the base 110, for example, using bolts. The support plates 198 have holes 199 adapted to receive the support poles. The support plates 198 span a wide area of holes to properly disperse the load from the support poles. Since the support pole and mounting beams are connected to the support plates 198, instead of directly to the base 110, stability is increased and less force is applied to the plastic floating modular dock.

According to certain exemplary embodiments of the invention, a motor 191 is mounted on the base 110. In the present illustration, the motor 191 is illustrated in the embodiment in FIG. 4. The motor 191, however, may be incorporated into any of the embodiments of the invention. The motor 191 is mounted to the base 110 to power the floating amusement apparatus. The motor 191 allows a user to steer, pull and push the floating amusement apparatus in any direction.

The floating amusement apparatus 100 includes one or more staircases for accessing each of the elevated platforms. A first staircase 130 is disposed between the base 110 and the first platform 120. A second staircase 132 is disposed between the base 110 and the second platform 140. A third staircase 134 is disposed between the first platform 120 and the third platform 160. The number and configuration of the staircases is merely exemplary and will vary depending on the number and configuration of elevated platforms.

Figure 4:
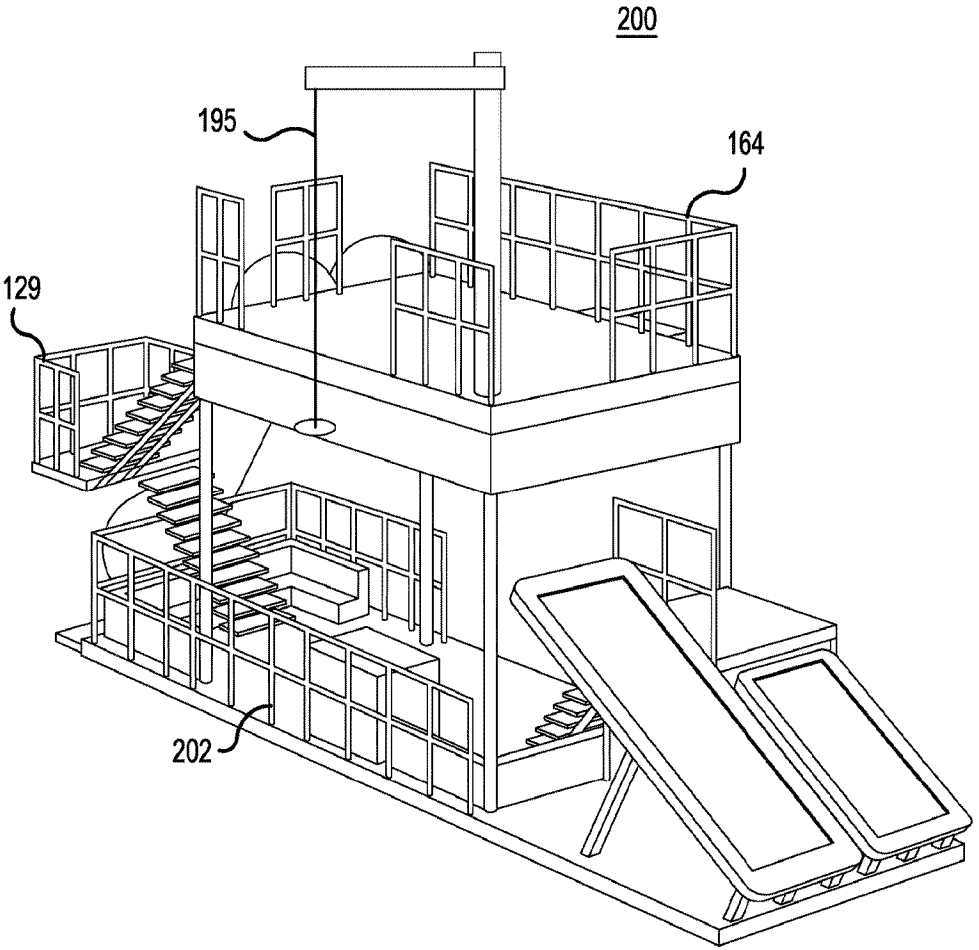
FIG. 4 illustrates a perspective view of a floating amusement apparatus 200 according to a second, exemplary, non-limiting embodiment of the present invention.
Figure 5:
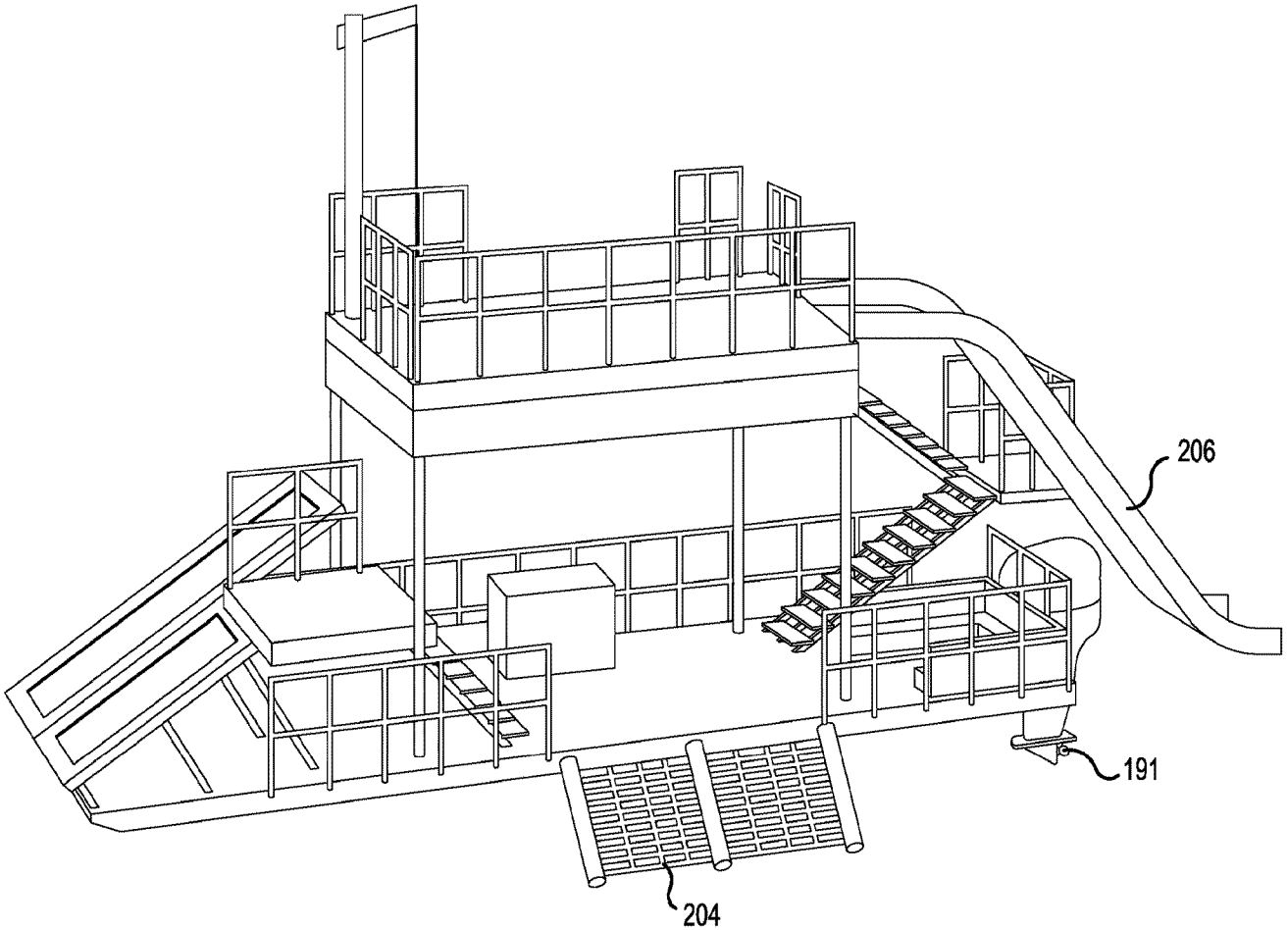
FIG. 5 illustrates another perspective view of the floating amusement apparatus 200.

FIGS. 4 and 5 illustrate a floating amusement apparatus according to a second, exemplary, non-limiting embodiment of the present invention. The second embodiment is substantially similar to that of the first embodiment. Accordingly, only features different from that of the first embodiment will be discuss in detail herein. One of ordinary skill in the art will appreciate the features of the first embodiment and the second embodiment may be interchanged and incorporated into the respective embodiments. As is illustrated in FIGS. 4 and 5, in the second embodiment, the curved slide 180 illustrated in FIGS. 1-3 is replaced with a straight, open slide 206. Additionally, the closed railings illustrated in FIGS. 1-3 are replaced with open railings 129/164 in FIGS. 4 and 5. Though any suitably safe railing configuration may be used on the elevated platforms. Furthermore, the embodiment illustrated in FIGS. 4 and 5 includes additional safety railings 202 disposed along portions of the base 110. Finally, the embodiment illustrated in FIGS. 4 and 5 includes a ladder or steps 204 for accessing the base 110 from the water.

The above configurations of the floating amusement apparatus 100/200 are merely exemplary. Any combination of elevated platforms and amusement accessories may be used. Additionally, the size of the base and the size and height of the elevated platforms may be adjusted based on user need. The following Table 1 illustrates some exemplary configurations for the floating amusement apparatus.

TABLE 1

| | | | |
|---|---|---|---|
| Size | large | medium | small |
| Slide | enclosed curve | long straight | long straight |
| Trampolines | two | one | one |
| High Dive | 14 feet above water | 12 feet above water | 10 feel above water |
| Rope Swing | Large pole: upper deck | Small pole: lower deck | None |
| Base Width | 12 feet | 10 feet | 8 feet |
| Base Length | 34 feet | 28 feet | 24 feet |
| Attractions | SIX: Slide, High Jump, Medium Jump, Rope Swing, 2 Trampolines | FIVE: Slide, High Jump, Trampoline, Rope Swing, Diving Board | THREE; Slide, High Jump, Trampoline |
| Delivery | Delivered in pieces and assembled for 1-2 days at water ramp | Delivered assembled, just 45 minutes of prep | Delivered assembled, just 30 minutes of prep |

TABLE 1-continued

| | | | |
|---|---|---|---|
| Trailer/ Removal | Due to its size, not recommended to take out of water frequently, but possible | Can easily be taken out of water with flatbed trailer, width is slightly over and may need permit for travel on road | Can easily be taken out of water with flatbed trailer |
| Capacity | 40 people | 33 people | 25 people |

Figure 6:
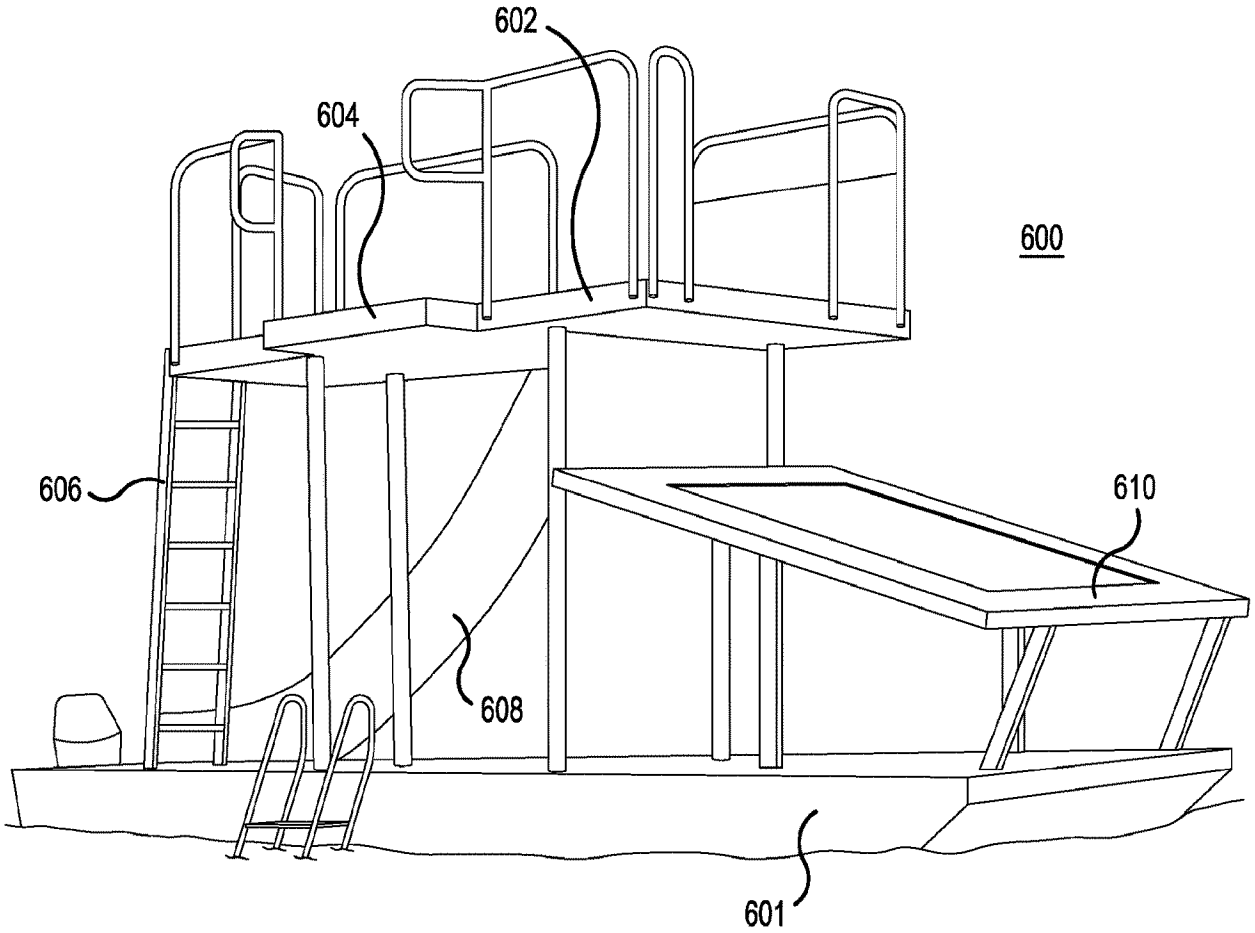
FIG. 6 illustrates a perspective view of a floating amusement apparatus 300 according to a third, exemplary, non-limiting embodiment of the present invention.

FIG. 6 illustrates a floating amusement apparatus 300 according to another exemplary embodiment of the present invention. The embodiment illustrated in FIG. 6 represents a small version of the floating amusement apparatus as described above in Table 1. The floating amusement apparatus 300 includes a single elevated platform 602 having a ladder 606 for accessing the elevated platform 602 from the base 601. The floating amusement apparatus 300 also includes three amusement accessories, including a high-dive platform 604, a slide 608 and a trampoline 610.

In accordance with certain other embodiments of the invention, the floating amusement apparatus may also be designed as a stationary dock model. This would allow the user to permanently or semi-permanently install the floating amusement apparatus at their home or other location. Additionally, the base 110 could be designed a permanent dock having the amusement accessories positioned at one end while allowing boats to be docked at an opposite end.

Moreover, certain other embodiments of the invention may include a seating area having seats, tables, coolers, etc.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A floating amusement apparatus for floating on water comprising:

a base comprising a single modular floating dock extending continuously from a leading end to a second trailing end thereof and extending continuously between a first lateral side and a second lateral side thereof such that the base forms a single continuous top surface;

first, second and third elevated platforms secured to and supported above the single continuous top surface of the single modular floating dock, the third elevated platform is located between the first and the second elevated platforms, and the third elevated platform is spaced a greater distance away from the single continuous top surface than both the first and the second elevated platforms;

a plurality of user-interactive amusement accessories being secured to either the base or the at least one of the first, the second and the third elevated platforms, and each of the plurality of user-interactive amusement accessories are designed to assist a user of one of the user-interactive amusement accessories with entering the water;

a first staircase extending from the base to the first elevated platform;

a second staircase extending from the base to the second elevated platform; and a third staircase extending from the second elevated platform to the third elevated platform such that access to the third elevated platform is only provided by way of the third staircase; and the floating amusement apparatus is adapted to be mobile.

2. The floating amusement apparatus according to claim 1, wherein each of the first elevated platform, the second elevated platform and the third elevated platform is disposed at a different height from one another.

3. The floating amusement apparatus according to claim 1, wherein the plurality of user-interactive amusement accessories comprises:

a slide disposed on the third elevated platform;

a rope swing disposed on the third elevated platform; and a high-dive disposed on the third elevated platform.

4. The floating amusement apparatus according to claim 3, wherein the plurality of user-interactive amusement accessories further comprises one or more trampolines positioned on the base adjacent the first elevated platform.

5. The floating amusement apparatus according to claim 4, wherein the plurality of user-interactive amusement accessories further comprises a low-dive disposed on the second elevated platform, and the low-dive comprises an extended edge which extends from the first elevated platform.

6. The floating amusement apparatus according to claim 1, wherein a first trampoline is mounted on the base adjacent to but below the first elevated platform and the first trampoline extends, in an inclined orientation relative to the base, between the first elevated platform and the leading end of the base; and a second trampoline is mounted on the base adjacent to both the first elevated platform and the third elevated platform and the second trampoline extends, in an inclined orientation relative to the base, between the third elevated platform and the leading end of the base.

7. The floating amusement apparatus according to claim 1, wherein the plurality of user-interactive amusement accessories comprises:

a slide disposed on the third elevated platform;

a rope swing disposed on the third elevated platform;

a high-dive disposed on the third elevated platform;

a low-dive disposed on the second elevated platform, and the low-dive comprise an edge which extends from the first elevated platform;

a first trampoline positioned on the base adjacent to and below the first elevated platform; and a second trampoline positioned on the base adjacent to and below the third elevated platform but at least partially above the first elevated platform.

8. The floating amusement apparatus according to claim 1, wherein the plurality of user-interactive amusement accessories comprises a slide, at least one jump platform, a rope swing or at least one trampoline.

9. The floating amusement apparatus according to claim 1, wherein the plurality of user-interactive amusement accessories comprises a slide, at least one jump platform, a rope swing or at least one trampoline and combinations thereof.

10. The floating amusement apparatus according to claim 1, wherein the plurality of user-interactive amusement accessories comprises any combination of a slide, at least one jump platform, a rope swing and at least one trampoline.

11. The floating amusement apparatus according to claim 1, wherein the plurality of user-interactive amusement accessories comprises a slide, a jump platform at a first height, a second jump platform at a second height different from the first height, a rope swing and a plurality of trampolines.

12. The floating amusement apparatus according to claim 1, further comprising:

a plurality of vertically disposed support poles each supporting one of the first, the second and the third elevated platforms; and a plurality of support plates disposed on the base, wherein each of the plurality of vertically disposed support poles is secured to the base via a respective one of the plurality of support plates.

13. A floating amusement apparatus for floating on water, the floating amusement apparatus comprising:

a base comprising a single modular floating dock extending continuously from a leading end to a second trailing end thereof and extending continuously between a first lateral side and a second lateral side thereof such that the base forms a single continuous top surface;

a second elevated platform being secured to the single continuous top surface, adjacent the trailing end of the base, the second elevated platform being supported above the single continuous top surface at a first height, and the second elevated platform having an end portion which extends beyond the second lateral side of the base and forms a jumping/diving platform;

a first elevated platform being secured to the single continuous top surface, adjacent to but spaced from the leading end of the base, and the first elevated platform being supported above the single continuous top surface at a second height;

a third elevated platform being secured to a generally central portion of the single continuous top surface, between the first elevated platform and the second elevated platform, and the third elevated platform being supported above the single continuous top surface at a third height which is greater than the first height and the second height;

a first staircase extending from the single continuous top surface to the first elevated platform;

a second staircase extending from the single continuous top surface to the second elevated platform;

a third staircase extending from the second elevated platform to the third elevated platform;

a slide having a first end supported by the third elevated platform and a second end supported adjacent the trailing end of the base and access to the slide being provided via a slide opening;

a rope swing mounted on the third elevated platform and extending from the second lateral side of the base substantially normal to the first lateral side;

a first trampoline being mounted on the base adjacent to but below the first elevated platform and extending, in an inclined orientation relative to the base, between the first elevated platform and the leading end of the base;

a second trampoline being mounted on the base adjacent to both the first elevated platform and the third elevated platform and extending, in an inclined orientation relative to the base, between the third elevated platform and the leading end of the base; and a high-dive being disposed on the third elevated platform and access to the high dive being provided via the dive opening.

14. The floating amusement apparatus according to claim 13, wherein a top surface of the first elevated platform is covered with a covering which is designed to prevent slippage by a user of the floating amusement apparatus.

15. The floating amusement apparatus according to claim 13, wherein a top surface of the second elevated platform is covered with a covering which is designed to prevent slippage by a user of the floating amusement apparatus.

16. The floating amusement apparatus according to claim 13, wherein a top surface of the third elevated platform is covered with a covering which is designed to prevent slippage by a user of the floating amusement apparatus.

17. The floating amusement apparatus according to claim 13, wherein access to the third elevated platform is only provided by way of the second staircase to the second elevated platform and the third staircase to the third elevated platform.

18. The floating amusement apparatus according to claim 13, wherein each of the first and the second trampolines extend parallel to one another but the first trampoline is located closer to the base than the second trampoline, and a lead edge of the first trampoline is spaced further from the trailing end of the base than a lead edge of the second trampoline.

19. The floating amusement apparatus according to claim 13, wherein a motor is supported at the trailing end of the base to facilitate maneuvering of the floating amusement apparatus in water.

20. A floating amusement apparatus for floating on water, the floating amusement apparatus comprising:

a base comprising a single modular floating dock extending continuously from a leading end to a second trailing end thereof and extending continuously between a first lateral side and a second lateral side thereof such that the base forms a single continuous top surface;

a second elevated platform being directly secured to the continuous top surface via a plurality of support poles and support plates, adjacent to but spaced from the trailing end of the base, the second elevated platform being supported above the single continuous top surface at a first height, and the second elevated platform having an end portion which extends beyond the second lateral side of the base to form a jumping/diving platform for use by a user when jumping into the water;

a first elevated platform being directly secured to the continuous top surface via a plurality of support poles and support plates, adjacent to the leading end of the base, the first elevated platform being supported above the single continuous top surface at a second height and the second elevated platform supporting a railing for preventing a fall from the first elevated platform;

a third elevated platform being directly secured to a generally central portion of the continuous top surface, via a plurality of support poles and support plates, between the first elevated platform and the second elevated platform, the third elevated platform being supported above the continuous top surface at a third height which is greater than the first height and the second height, and a railing extending at least partially along four sides of the third elevated platform for preventing a fall from the third elevated platform with the railing of the third elevated platform having a first opening, a second opening, a third opening and a fourth opening;

a first staircase extending from the base to the first elevated platform;

a second staircase extending from the base to the second elevated platform;

a third staircase extending from the second elevated platform to the third elevated platform so that access to the third elevated platform, via the fourth opening, is only provided by way of the second staircase to the second elevated platform and the third staircase to the third elevated platform;

a slide having a first end supported by the third elevated platform and a second end supported adjacent the trailing end of the base, and access to the slide is provided via the third opening;

a rope swing mounted on the third elevated platform and extending from the second lateral side of the base substantially normal to the second lateral side;

a first trampoline being mounted on the continuous top surface adjacent to but below the first elevated platform and extending, in an inclined orientation relative to the continuous top surface, between the first elevated platform and the leading end of the base to facilitate propelling a user, who jumps on the first trampoline, into the water;

a second trampoline being mounted on the continuous top surface adjacent to both the first elevated platform and the third elevated platform and extending, in an inclined orientation relative to the continuous top surface, between the third elevated platform and the leading end of the base, and the second opening facilitates a user jumping onto the second trampoline and being propelled by the second trampoline into the water;

each of the first and the second trampolines extending parallel to one another but the first trampoline being located closer to the base than the second trampoline; and a high-dive being disposed on the third platform and access to the high dive being provided via the first opening.

* * * * *